US010220984B1

(12) United States Patent
Vigoureux

(10) Patent No.: US 10,220,984 B1
(45) Date of Patent: Mar. 5, 2019

(54) UNIVERSAL CONTAINER LID

(71) Applicant: Matthew M. Vigoureux, Ponte Vedra Beach, FL (US)

(72) Inventor: Matthew M. Vigoureux, Ponte Vedra Beach, FL (US)

( * ) Notice: Subject to any disclaimer, the term of this patent is extended or adjusted under 35 U.S.C. 154(b) by 103 days.

(21) Appl. No.: 15/093,142

(22) Filed: Apr. 7, 2016

Related U.S. Application Data

(60) Provisional application No. 62/145,978, filed on Apr. 10, 2015.

(51) Int. Cl.
*B65D 43/02* (2006.01)
*B65D 47/06* (2006.01)
*A47G 19/22* (2006.01)

(52) U.S. Cl.
CPC ..... *B65D 43/02* (2013.01); *A47G 19/2272* (2013.01); *B65D 47/06* (2013.01); *B65D 2251/08* (2013.01)

(58) Field of Classification Search
CPC .... B65D 43/02; B65D 47/06; B65D 2251/08; A47G 19/2272
USPC ..... 220/709, 287, 796, 780; 215/389
See application file for complete search history.

(56) References Cited

U.S. PATENT DOCUMENTS 2,034,739 A * 3/1936 Bodor ..... B65D 79/005 215/271
2,126,322 A * 8/1938 Garfield ..... A61J 11/02 215/11.5
2,569,139 A 9/1951 Abelson
2,585,602 A * 2/1952 Turner ..... A01K 97/08 138/109
2,962,187 A * 11/1960 Morris ..... A01K 97/08 206/315.11
3,862,614 A * 1/1975 Kovac ..... B65D 41/22 206/820
4,811,860 A * 3/1989 Sorenson ..... B65D 43/0212 206/508
4,948,009 A * 8/1990 Sawatani ..... A23F 5/243 215/388
6,260,729 B1 * 7/2001 Mitchell ..... B65D 41/22 150/154
6,305,584 B1 10/2001 Dobobrov et al.
6,609,630 B1 8/2003 Freeman et al.
2004/0206765 A1 * 10/2004 McMahon, III ... B65D 43/0222 220/780
2005/0139081 A1 6/2005 Lima
2005/0230405 A1 10/2005 Dix
2006/0021991 A1 * 2/2006 Liu ..... B65D 43/0212 220/793

(Continued)

FOREIGN PATENT DOCUMENTS

WO 2014160642 A1 10/2014

*Primary Examiner* — James N Smalley
(74) *Attorney, Agent, or Firm* — H. John Rizvi; John Rizvi, P.A.

(57) ABSTRACT

A universal container lid for covering containers of differing diameters includes a circular top section formed of a center section receiving a straw therethrough and at least one expansion fold circumferentially affixed about the center section wherein the top section terminates at an outer diameter thereof. A substantially cylindrical sidewall extends downwardly from the top section outer diameter. The universal container lid can be stretched or compressed to tightly fit onto containers of differing diameters.

18 Claims, 10 Drawing Sheets

(56) References Cited

U.S. PATENT DOCUMENTS

| | | | | |
|---|---|---|---|---|
| 2006/0060584 | A1* | 3/2006 | Onoda | B65D 41/22 220/287 |
| 2006/0163251 | A1 | 7/2006 | Kelstrom et al. | |
| 2007/0090081 | A1 | 4/2007 | Briscoe et al. | |
| 2011/0056968 | A1 | 3/2011 | McNamara et al. | |
| 2011/0259846 | A1 | 10/2011 | Diegel et al. | |
| 2012/0067910 | A1 | 3/2012 | Chun | |
| 2012/0145727 | A1* | 6/2012 | Gammage | A47G 19/2211 220/709 |
| 2012/0199588 | A1 | 8/2012 | Wheeler | |
| 2012/0325833 | A1 | 12/2012 | Connors, Jr. et al. | |
| 2013/0233854 | A1 | 9/2013 | Smyers et al. | |
| 2013/0334233 | A1 | 12/2013 | Vandenlangenberg | |
| 2014/0110409 | A1 | 4/2014 | Gindi | |
| 2015/0182045 | A1* | 7/2015 | Hobeich | B65D 47/06 215/229 |

* cited by examiner

UNIVERSAL CONTAINER LID

CROSS-REFERENCE TO RELATED APPLICATION

This application claims the benefit of U.S. Provisional Patent Application Ser. No. 62/145,978, filed Apr. 10, 2015, which is incorporated herein by reference in its entirety.

FIELD OF THE INVENTION

The present invention relates generally to a lid for a container, and more particularly, to a lid having a non-rigid, flexible construction that permits the lid to elastically conform to the shape of the container in a fluid-tight sealing arrangement.

BACKGROUND OF THE INVENTION

A beverage container is typically provided with a specially sized, complementary lid that is specifically dimensioned to fit onto the rim of the container in a fluid-tight arrangement. The lid can be secured to the container in a variety of ways, including a press fit and a threaded connection. The beverage container and lid come as a matched pair due to their complementary geometrical fit. This unique pairing prevents the possibility that the individual pieces from one container-lid combination could be used interchangeably with the pieces from another such combination. It is not uncommon, then, for a consumer to have an assortment of beverage containers accompanied by a variety of different-sized lids each capable of servicing just a single, dedicated container.

The collection of containers and lids can be inefficient and wasteful, requiring space to store all of these pieces. There is also the added incremental expense of equipping each container with its own lid. If a lid goes missing or is broken, the only option available to the consumer is to purchase another lid (which is difficult since lids are typically not sold separately but in a package with the container) or to limit the use of the container to drinking activities that do not require sealing arrangements, which essentially defeats the original purpose of the container.

One alternative to the purchase of a collection of unique container-lid combinations is the use of a disposable cup and lid each time a beverage is consumed. This way, an individual need not worry about keeping a variety of reusable containers and lids on hand. Instead, a collection of disposable items like Styrofoam cups and plastic lids can be used. While this option eliminates the need to keep track of containers and lids, it does introduce the new expense of regularly purchasing the disposable products. Additionally, the use of disposable items creates more waste, causing an environmental impact.

Accordingly, there is an established need for a lid capable of accommodating a variety of different sized containers, which is washable, reusable, and eco-friendly.

SUMMARY OF THE INVENTION

The present invention is directed to a universal lid having an elastic construction. The lid includes a solid top section having an integrally-formed straw or a central orifice to accommodate the insertion of a straw. The lid further includes a sidewall extending in a generally longitudinal direction from the top section defining a sleeve-like formation. The sidewall includes an upper end and a lower end.

The sidewall is joined to the top section at its upper end. The lid can stretch or compress to adjust to containers of differing diameters.

In a first implementation of the invention, a container lid for covering containers of differing diameters includes a top section and a sidewall, both of which are stretchable, elastic and fluid impervious. The top section has at least one expansion fold arranged circumferentially about a center section of the top section, the expansion fold being foldably expandable or compressible to increase or reduce a width of the top section. The sidewall extends downwardly from the top section around a full perimeter thereof.

In a second aspect, the top section can be circular and the sidewall can be substantially cylindrical or frustoconical.

In another aspect, the top section and the sidewall can be integrally formed as a single-piece unit. Alternatively, the top section and the sidewall can be attached to one another.

In another aspect, the lid can further include a straw positioned at the top section and integrally formed with the top section. Alternatively, the top section can present an orifice for removably receiving a straw therethrough.

In another aspect, the at least one expansion fold can be \'-shaped.

In another aspect, the top section can include two or more expansion folds arranged circumferentially about the center section of the top section, extending in a concentric relationship with one another, and forming an accordion-type stretchable portion of the top section.

In another aspect, the lid can include one or more tabs extending from a bottom of the sidewall and away from the top section. In some embodiments, at least one of the tabs can extend radially outward from the bottom of the sidewall. Alternatively or additionally, at least one of the tabs can extend from the bottom of the sidewall in surface continuation with the sidewall.

In another aspect, the top section and/or the sidewall can be formed of a fluid impervious elastic material.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed towards a universal lid capable of elastic deformation, enabling the lid to cover a variety of different-sized beverage containers and to provide a fluid-tight seal.

Figure 1:
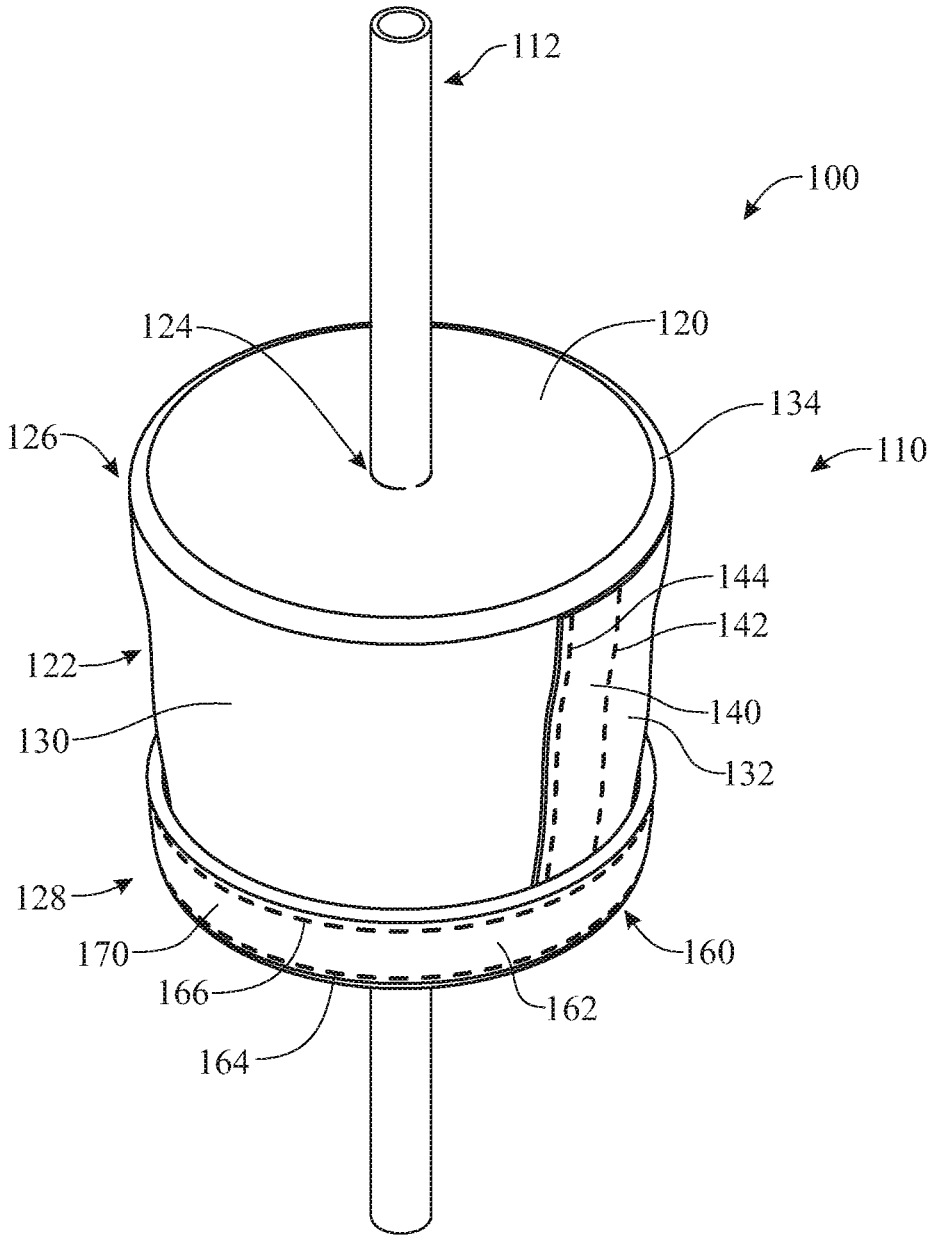
FIG. 1 presents an isometric top view of a container lid according to a first illustrative embodiment of the present invention, showing the lid assembled with a straw.
Figure 2:
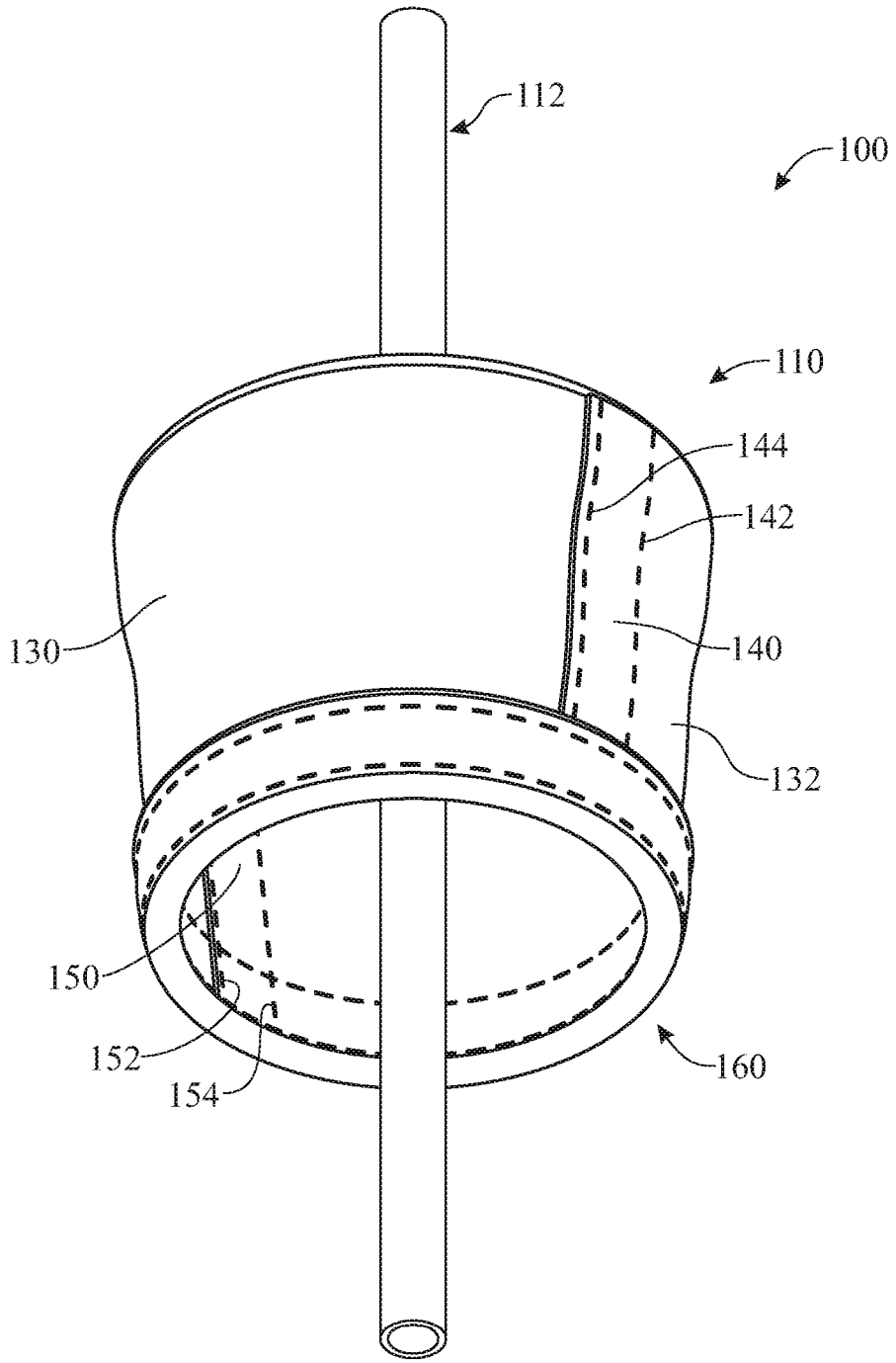
FIG. 2 presents an isometric bottom view of the assembly originally introduced in FIG. 1.
Figure 3:
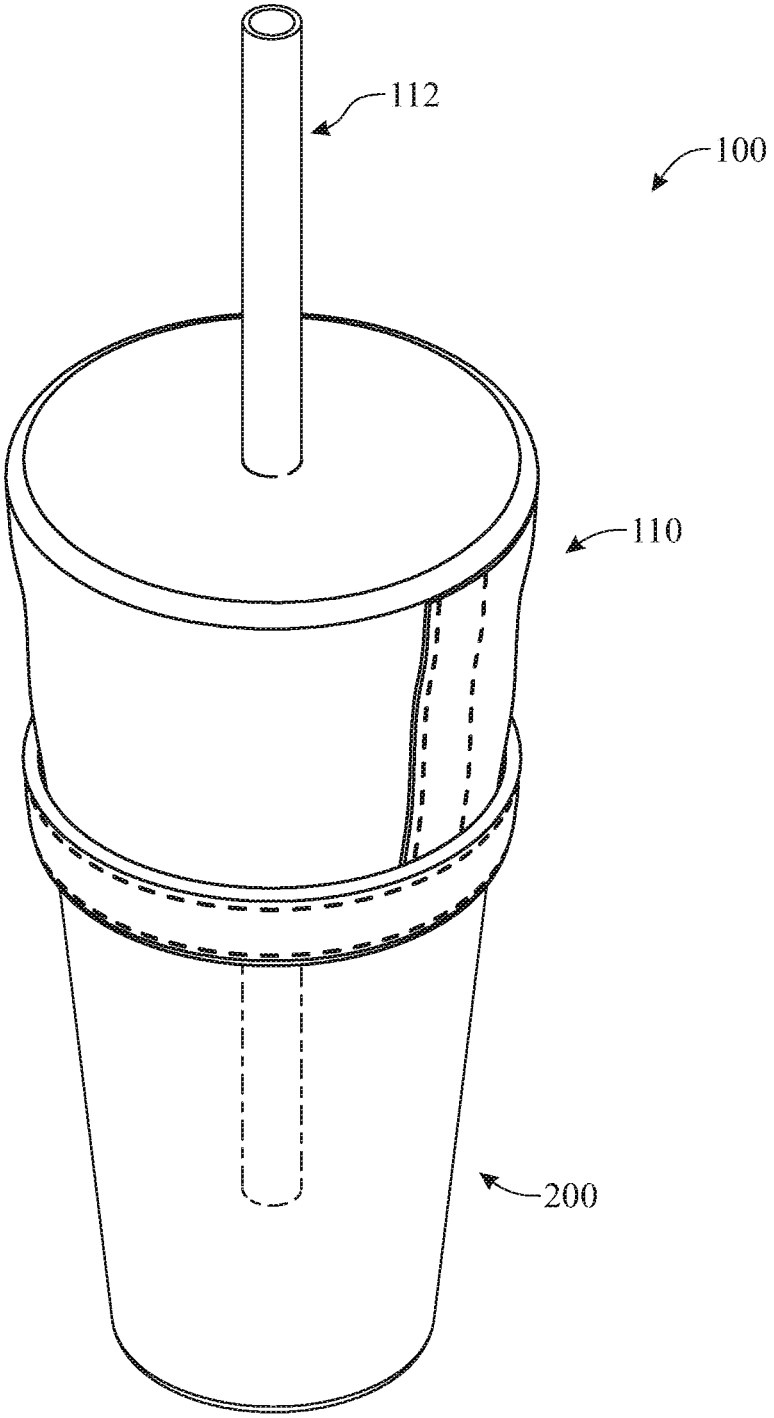
FIG. 3 presents an isometric top view of the lid and straw assembly originally introduced in FIG. 1, showing its installation with a first exemplary container.
Figure 4:
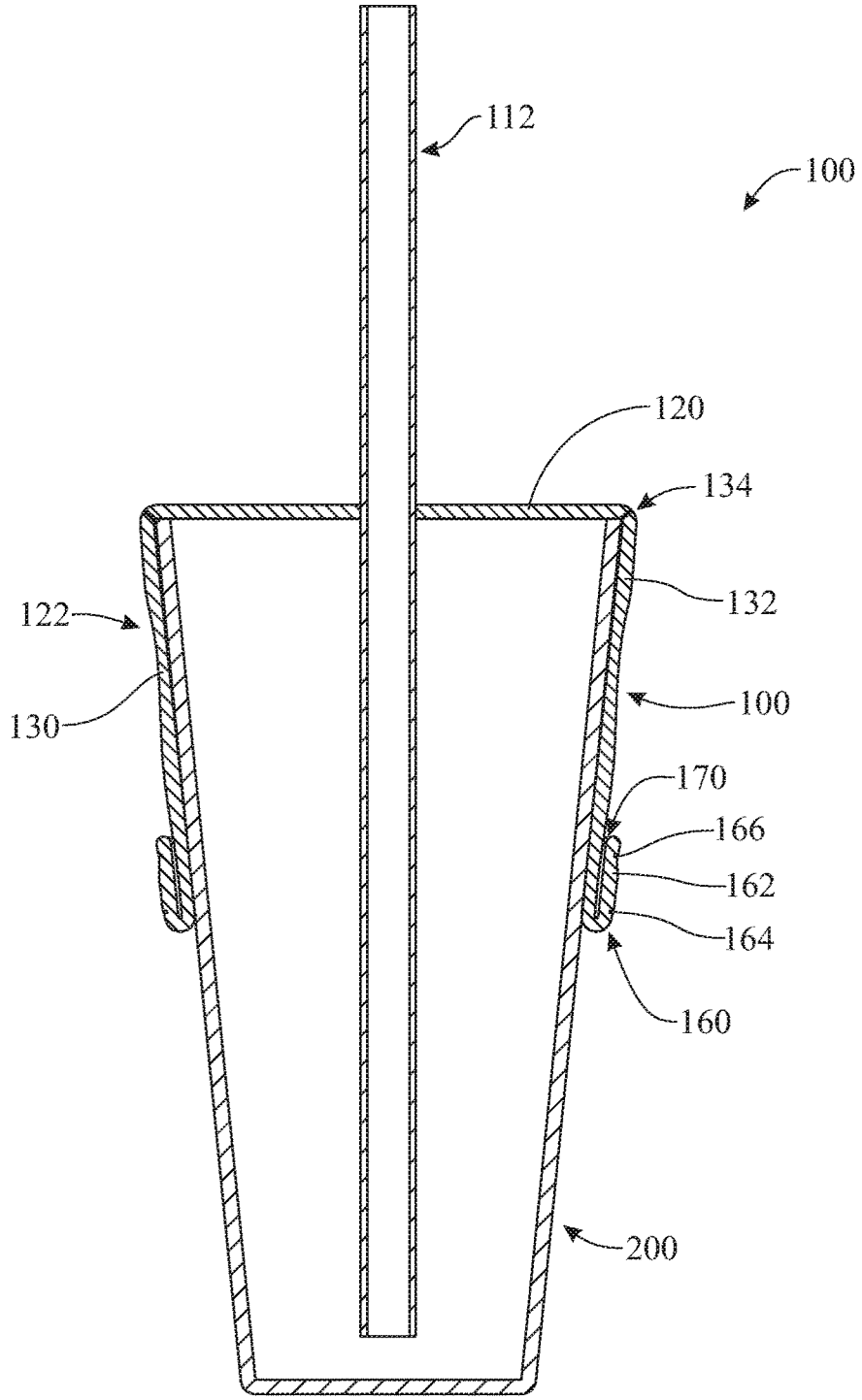
FIG. 4 presents a cross-sectional side elevation view of the lid and straw assembly as installed on the first exemplary container, as shown in FIG. 3.

Referring initially to FIGS. 1 through 4, a lid 110 is illustrated in accordance with an exemplary embodiment of the present invention, configured to fit over an illustrative cup or beverage container 200 in a fluid-tight sealing arrangement, as shown in FIGS. 3 and 4. The lid 110 is a distinct piece that may be assembled with a straw 112 to form a lid and straw combination 100. The straw 112 of the present embodiment is selectively removable from the lid 110. In alternative embodiments, the straw 112 can be integrally formed with and non-separable from the lid 110, such as by having the straw 112 manufactured together with all or part of the lid 110, into a single plastic part, by injection molding of one or more plastic materials.

The lid 110 includes a top section 120 connected to a sidewall or body section 122 at joint interface 134. The joint interface 134 can be defined as the junction or boundary where the peripheral rim of top section 120 meets the uppermost edge of body section 122. The lid 110 is preferably made of a material composition that enables the lid 110 to flex and stretch in a variety of dimensions and directions. In a preferred form, the lid 110 is configured to have the property of elastic deformation so that it can be used to cover a variety of different-sized containers, and yet return to its normal, relaxed state when removed from a container.

In the relaxed or non-stretched state of lid 110, the top section 120 preferably has a generally planar and circular shape, although other geometries are possible. The top section 120 defines the principal part of lid 110 that covers the mouth of container 200 when the lid 110 is deployed on the container 200, as shown in FIGS. 3 and 4. The top section 120 of the present embodiment includes an orifice or opening 124 formed at a generally central location. The straw 112 of the present embodiment is received through the top section 120 of lid 110 by insertion through opening 124. Due to the elastic properties of lid 110, the periphery of opening 124 can flex in response to the insertion of a straw having a diameter greater than the diameter of the opening 124 in its relaxed state. This flexing behavior permits lid 110 to accommodate a variety of different sized straws. During use, when the combination 100 is deployed or situated on a container 200, the straw 112 is advanced through the top section 120 of lid 110 (via opening 124) in a working relationship sufficient to enable a user to withdraw fluid from container 200 through straw 112.

With continued reference to FIG. 1, the body section 122 of lid 110 includes a first sidewall 130 and a second sidewall 132 joined together to form a sleeve-like configuration having a hollow, generally tubular, preferably frustoconical or cylindrical arrangement. In this sleeve-like configuration, the first sidewall 130 and the second sidewall 132 each have a generally curved shape, facilitating the tight, covering engagement of lid 110 to container 200, which is typically rounded. The body section 122 is connected at an upper end 126 to top section 120 (via joint interface 134) to form a single, integrated assembly. This connection can be implemented in any suitable way known to those skilled in the art, such as by sewing or stitching. The body section 122 also has a lower, free end 128 to define the bottom of lid 110. The body section 122 and the top section 120 are connected together at the joint or interface 134 that defines a peripheral boundary of top section 120 and defines the uppermost edge of body section 122. In a preferred arrangement, when the top section 120 is configured in a generally planar form, the body section 122 extends away from top section 120 (at joint 134) in a generally longitudinal direction that is generally orthogonal to the surface of top section 120 (the body section 122 therefore being cylindrical) or slightly tapered relative to the surface of top section 120 (the body section 122 therefore being frustoconical). In one configuration, the general shape of lid 110, consisting of top section 120 and body section 122, assumes the general shape of an elongated cover having a generally flat upper surface (i.e., top section 120) and a skirt-like shroud (i.e., body section 122) extending from the upper surface.

As shown best in FIGS. 1 and 2, the first sidewall 130 and the second sidewall 132 are joined together by a first seam 140 and a second seam 150. The first seam 140 is prepared by maneuvering the first sidewall 130 and the second sidewall 132 into a first overlapping arrangement. Then, a pair of generally parallel, longitudinal stitch lines 142 and 144 are executed to secure the first sidewall 130 and the second sidewall 132 together and form the first seam 140. Likewise, the second seam 150 is prepared by maneuvering the first sidewall 130 and the second sidewall 132 into a second overlapping arrangement. Then, a pair of generally parallel, longitudinal stitch lines 152 and 154 are executed to secure the first sidewall 130 and the second sidewall 132, together and form the second seam 150. In this fashion, the first sidewall 130 and the second sidewall 132, are joined together. The first seam 140 and the second seam 150 can be implemented in a variety of ways known to those skilled in the art, including sewing, gluing, stapling, or any other suitable fastening technique.

In a preferred form, as shown in the drawings, the first sidewall 130 and the second sidewall 132 are suitably configured so that when they are joined together, they cooperatively define a sleeve having a generally tapered, frustoconical shape. The sleeve or body section 122 tapers inwards from its upper end 126 (at the connection to top section 120) to its free, lower end 128. In particular, the body section 122 has a cross-sectional area that progressively decreases in the direction from the upper end 126 to the lower end 128 of body section 122, i.e., the cross-sectional area is largest at the upper end 126 and smallest at the lower end 128. The frustoconical orientation can also be inverted or reversed, if so desired, such that the upper end 126 has a smaller cross-sectional area compared to the lower end 128. In general, the sleeve-like arrangement of body section 122, defined by the cooperative connection of first sidewall 130 and second sidewall 132, is characterized by a generally circular cross-sectional profile (along its longitudinal dimension), which can be regular (i.e., a cylindrical prism) or variable (i.e., frustoconical).

The tapering geometry of body section 122 offers various advantages. A variety of containers are likewise made with a tapered body. The frustoconical shape of the body section 122 can naturally and readily conform to another tapered geometry. However, other beverage containers have a regular, fixed cross-section. The tapered profile of the body section 122 still has merit with these containers, since the sleeve-like shape of the body section 122 will form a tight fit with the container in places where the cross-section of the container is larger than the cross-section of the (relaxed) body section 122. This mismatch in size between the container 200 and lid 110 does not present a problem since the lid 110 (i.e., body section 122) can readily undergo or experience elastic deformation to accommodate coverage and placement over a comparatively larger container 200.

The body section 122 of lid 110 includes a bottom portion or cuff 160 at its lower end 128. The cuff 160 is a double-thick area that is formed when a lowermost peripheral area 162 of the body section 122 is folded over and back onto itself so that it becomes disposed in facing opposition to the main portion of body section 122. As a result, this folded-back area 162 overlaps with another portion of the body section 122, creating a small clearance space therebetween. This reverse or backward curling of overlap area 162 is easily performed due to the elastic properties of lid 110. The folded-back area 162 of cuff 160 is best shown in FIG. 4.

An internal, bottom elastic band 170 can be located within the clearance space formed by the folded-back area 162 of cuff 160. The elastic band 170 can be a generally circular or ring-shaped component that is annularly disposed about the body section 122. The circumferential slot or channel that receives and holds the elastic band 170 can be bounded by a pair of circumferential, parallel stitch lines 164 and 166 that secure the folded-back area 162 to the main portion of body section 122, securing the elastic band 170 in place. The elastic band 170 facilitates a very tight fit of the lid 110 to any container 200 regardless of its diameter. The elastic band 170 can flex in response to pressure bearing upon it, such as when the lid 110 is placed over container 200 and slid into place. The elastic band 170 provides a firm grip around the outer peripheral surface of the container 200 over which the lid 110 is placed. In its installed position, the elastic band 170 remains sandwiched between the folded-back area 162 and an opposing area of body section 122.

As mentioned heretofore, the lid 110 has a multi-piece construction that includes a set of three (3) interconnected sections: the top section 120 and, the pair of sidewalls 130 and 132 that are joined together to form the sleeve-like body section 122. The pieces may be connected and otherwise joined together using any suitable technology known to those skilled in the art, including, but not limited to, sewing. These individual pieces, and thus the lid 110 as a whole, are preferably made of a stretchable, elastic, impervious and non-toxic material, including, but not limited to, rubber, an elastomer, an FDA-approved neoprene, or any combination thereof. The individual sections can be made of the same or different materials. For example, a design choice can be made to manufacture the top section 120 with a material composition different than that chosen for the body section 122. A preferred property of the material composition is that it offers a fluid-impermeable barrier to prevent fluid from leaking through the material.

Referring now to FIGS. 3 and 4, in practice, the lid 110 is situated on container 200 in a working relationship sufficient to provide a suitable fluid-tight sealing cover over container 200. The straw 112 is inserted through the lid 110 in a manner sufficient to penetrate the required depth into container 200. Alternately, the lid 110 and straw 112 can be pre-assembled as the lid and straw combination 100, and this combination 100 can then be placed onto container 200, as opposed to installing the lid 110 and straw 112 in separate, distinct operations.

The installation of the lid 110 takes place by first aligning the opening formed at the lower end 128 of body section 122 with the mouth of container 200. The body section 122 is then continually advanced down the body of the container 200 until the top section 120 of the lid 110 reaches and spans the mouth of container 200. At this end point of travel for lid 110, the top section 120 lies substantially flat across the mouth of container 200 defined at the container rim. The body section 122 forms a watertight, sleeve-like seal around the outer portion of container 200 that it covers. A very firm, fluid-tight seal exists at the interface between lid 110 and the rim of container 200. Even if fluid somehow escapes past this lid-rim interface, its downward travel along the outer surface of container 200 would be substantially impeded, if not totally prevented, by the fluid-tight interface formed between the body section 122 of lid 110 and the opposing surface of container 200.

As best shown in FIG. 4, the installation of the lid 110 evidences various features that promote fluid-tight sealing. The top section 120 of the lid 110 covers and spans the entire mouth of container 200. The sleeve-like body section 122 of the lid 110 conforms tightly to the outer surface of container 200 and extends downwardly along the outer surface of container 200 in a skirt-like fashion.

In a preferred form, the lid 110 is designed and constructed such that the body section 122 will define a tubular, sleeve-like configuration that occupies a volume smaller than the volume of the container 200 that it is expected to cover. Thus, the lid 110 must be flexed and stretched relative to its relaxed state in order to fit over container 200. This flexing action creates a pressure-type contact bias against the container surface that the lid 110 is contacting, forming a fluid-tight, sealing interface.

In particular, it is desirable for the lid 110 to experience elastic deformation while it is deployed as a cover over container 200. This flexing and stretching activity will make the material fabric of the lid 110 more taut. As the lid 110 experiences this tautness, and undergoes elastic deformation in the process, it naturally develops a return bias that attempts to restore the lid 110 to its normal, relaxed state. This restorative, spring-back action develops because of the elastic deformation properties of the material composition of lid 110. As a result of this restorative bias or tendency, the first sidewall 130 and the second sidewall 132 of the body section 122 will press tightly against the outer surface of container 200 to effectively close-out or eliminate any clearance space at the interface between the lid 110 and container 200. The body section 122 thus conforms precisely to the contour and shape of the container 200. In this manner, a fluid-tight seal develops between the sleeve-like body section 122 of lid 110 and the outer surface of container 200, preventing any fluid from leaking past lid 110. In its installed condition, the top section 120 extends across the mouth of container 200 in a generally flat or planar orientation parallel to the bottom of container 200. The elastic band 170 installed at cuff 160 of the body section 122 of lid 110 provides an additional measure of firm, grip-like control of lid 110 about container 200. In operation, the lid 110 can simply be stretched over any-sized container 200; and, the elastic cover (lid 110) will stretch across while fitting tightly around the container 200, making the container 200 spill-proof.

After use, the lid 110 can be removed from the container 200, cleaned, and made available for further installation on another container. Due to its elastic construction, the lid 110 possesses a resilience that enables the lid 110 to return to its original shape once it is removed from the container 200.

Figure 5:
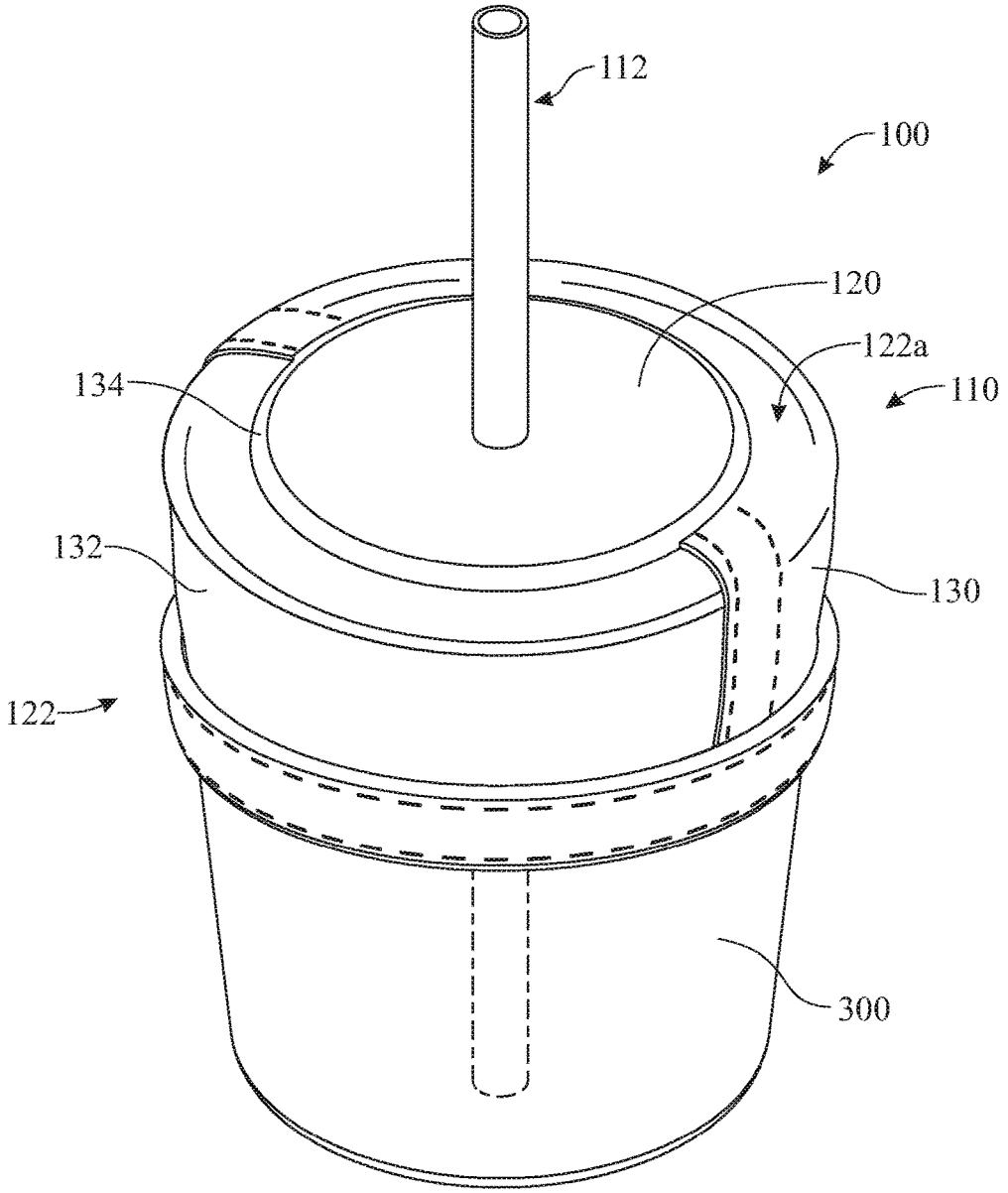
FIG. 5 presents an isometric top view of the lid and straw assembly of FIG. 1 as installed with a second exemplary container different from and wider than the first exemplary container of FIGS. 3 and 4, demonstrating the elastic deformation of the lid.
Figure 6:
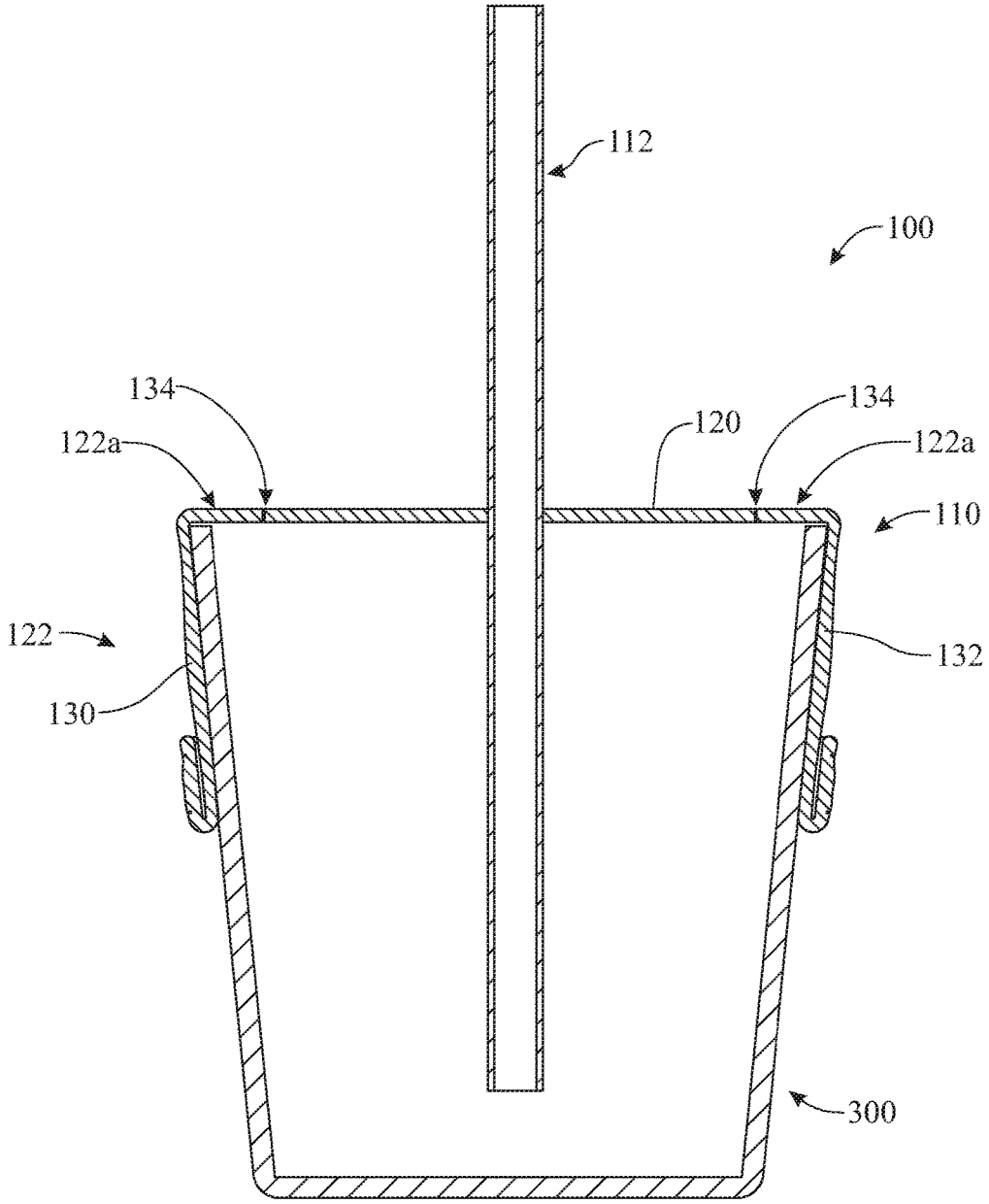
FIG. 6 presents a cross-sectional side elevation view of the lid and straw assembly as installed on the second exemplary container, as shown in FIG. 5.

Referring now to FIGS. 5 and 6, the installation of the lid and straw combination 100 is shown in relation to a container 300 having a cross-sectional area (at least at the container mouth) that is larger than the corresponding cross-sectional area of the container 200 of FIGS. 1 through 4, to illustrate the stretching capabilities of lid 110 to embrace different container diameters. In order to accommodate the size of container 300, and completely cover the top opening or mouth of container 300, the lid 110 stretches in such a fashion that an upper portion 122*a* of the body section 122 gets drawn over the rim of container 300 and extends part way into the mouth region of container 300. This upper portion 122*a* of the body section 122, consisting of relevant sections of the first sidewall 130 and the second sidewall 132, forms part of the covering offered by lid 110 (in addition to top section 120) to cover the mouth of container 300. As shown, the joint 134; which defines the interface between the top section 120 and the body section 122, has been relocated and is now positioned within the mouth area of container 300; compared to its previous location more proximal to the rim of the smaller container 200 (FIGS. 1 through 4).

The illustrations of FIGS. 5 and 6 demonstrate the ability of the lid 110 to accommodate containers of various sizes, specifically ones with increasingly larger cross-sections at the top. The lid 110 can fit over other containers that are even larger than the one depicted in FIGS. 5 and 6, since the body section 122 is long enough to enable an additional amount of it (i.e., in addition to portion 122*a*) to be drawn over the container rim to assist in forming the upper cover with top section 120. This retraction of body section 122 over the container rim can be done without compromising the overall effectiveness of the lid 110 in retaining its ability to conform tightly to the outer surface of the container and maintain a firm, fluid-tight engagement.

In alternative embodiments, the lid 110 can be formed as a single, unitary component having a uni-body construction, as compared to the multi-piece construction of lid 110 shown in FIGS. 1 through 6. Such a uni-body lid 110 is integrally formed as a single, stretchable piece having all of the same individual sections as the lid 110 shown in FIGS. 1 through 6, namely, the top section 120 and the body section 122 (preferably of a tapered geometry). The uni-body lid 110 can be manufactured using any suitable technology known to those skilled in the art, including, but not limited to, a plastics injection molding process. In certain embodiments, the uni-body lid 110 can be integrally formed with the straw 112, as explained heretofore. In alternative embodiments, the uni-body lid 110 and the straw 112 can be separate parts, allowing the straw 112 to be inserted into and removed from the uni-body lid 110 as desired.

Figure 7:
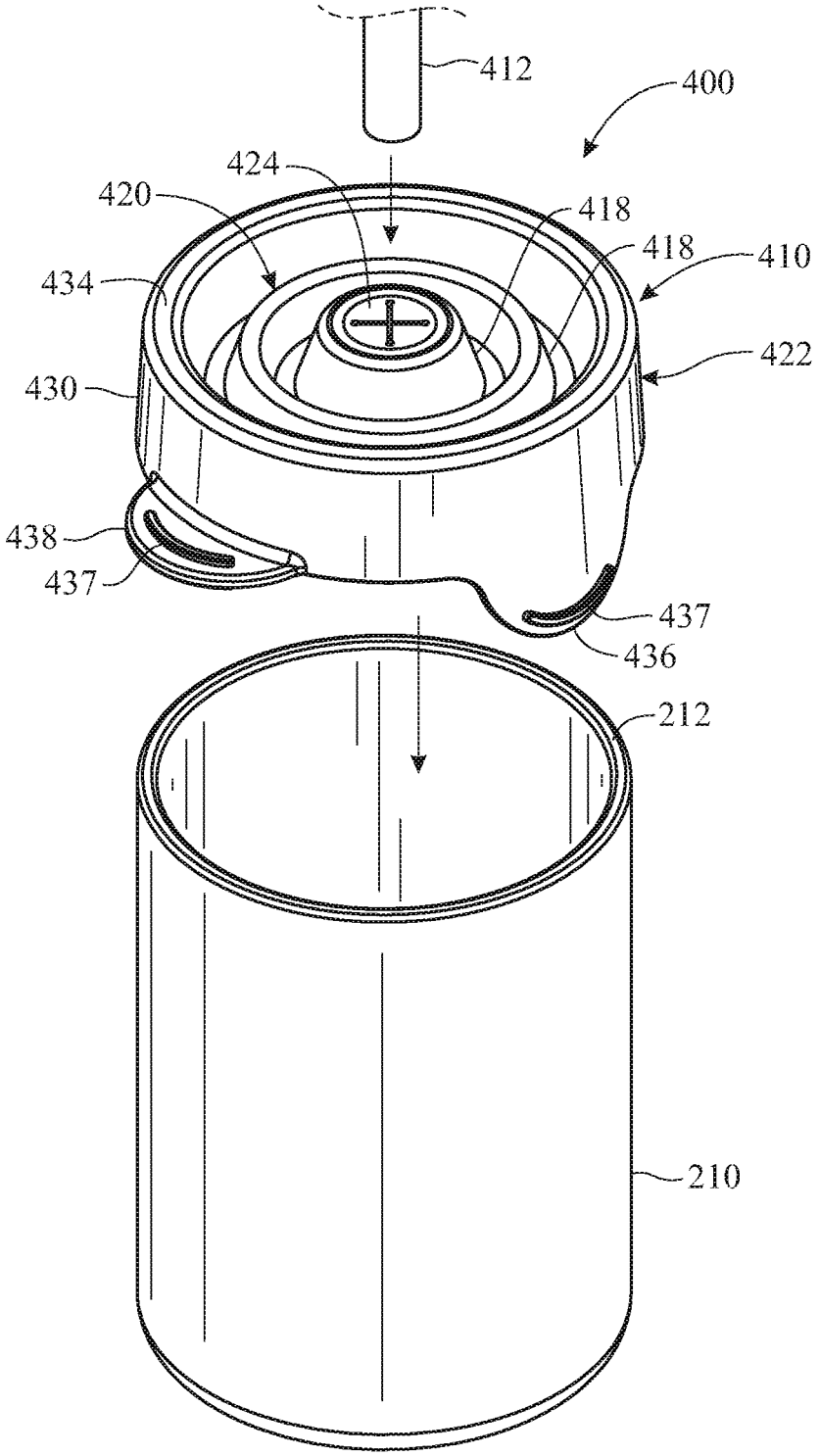
FIG. 7 presents an exploded top isometric view of a container lid according to a second, preferred embodiment of the present invention, showing a straw, the lid, and a container.
Figure 8:
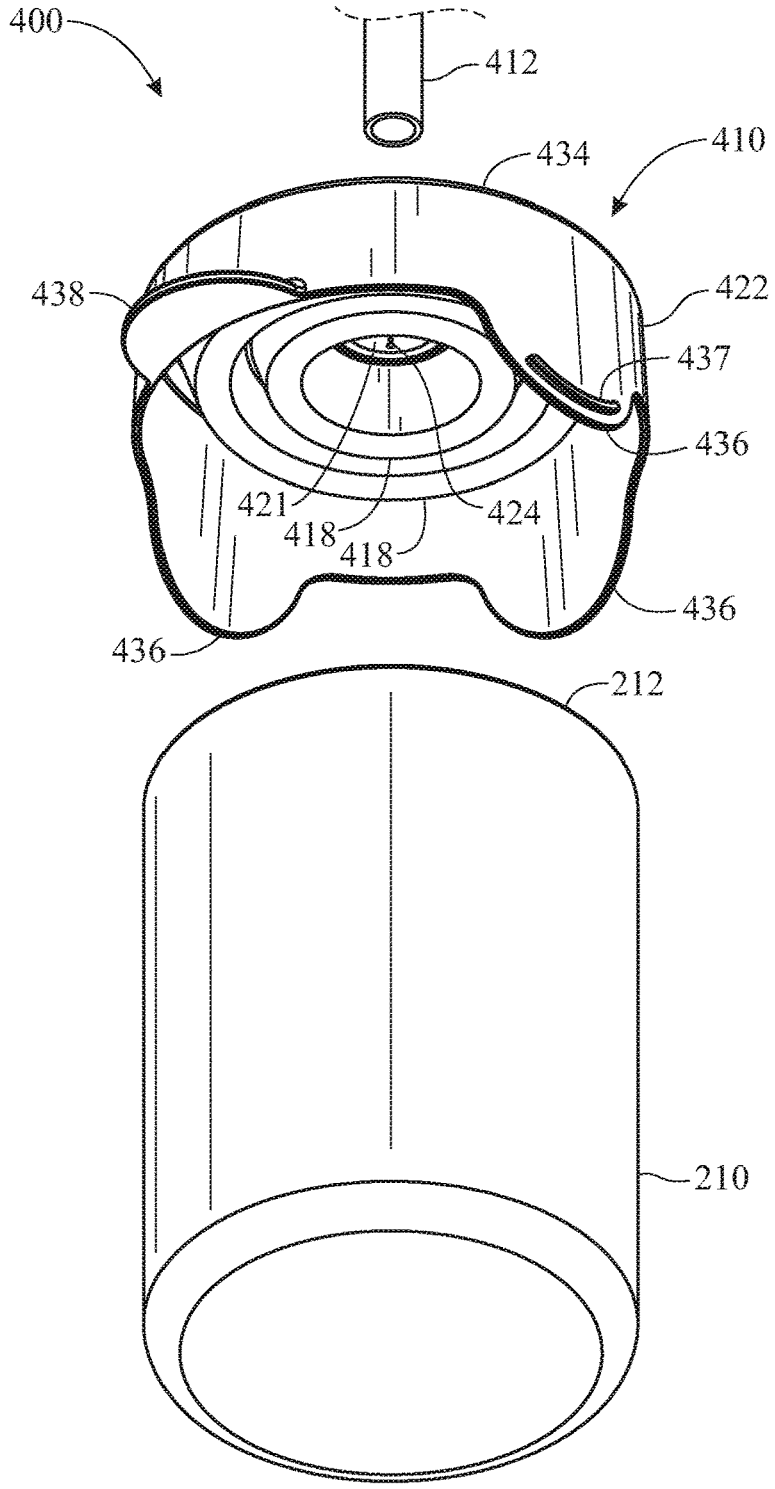
FIG. 8 presents an exploded bottom isometric view of the container, lid, and straw of FIG. 7.
Figure 9:
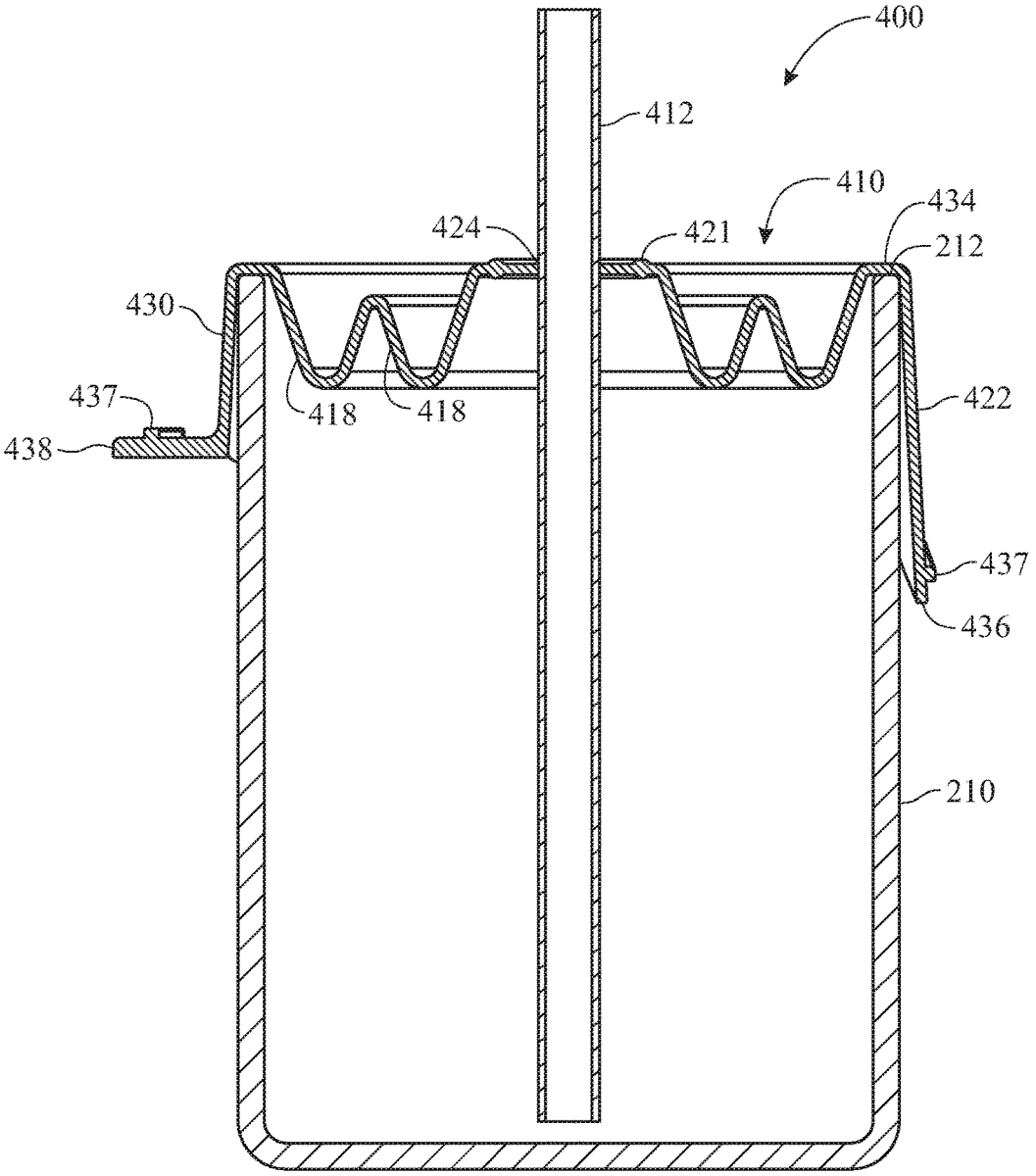
FIG. 9 presents a cross-sectional elevation view of the second embodiment lid and straw assembly installed on the container.

Referring now to FIGS. 7 through 10, a lid and straw combination 400 is illustrated in accordance with a second, preferred embodiment of the invention. The lid and straw combination 400 comprises a lid 410 and a straw 412. The straw 412 depicted herein is received through an orifice 424 in a center area 421 of the lid 410. While the straw 412 of the present embodiment is selectively removable from the lid 410, alternative embodiments are contemplated in which the straw 412 is integrally formed with and non-separable from the lid 410, such as by having the straw 412 manufactured together with all or part of the lid 410, into a single plastic part, by injection molding of one or more plastic materials. The lid and straw combination 400, as best shown in FIGS. 7 and 9, engages an upper rim 212 of a container 210 thereby sealing the interior of the container 210 to prevent any liquids stored therein from spilling.

The lid 410 is formed from a thin fluid impervious elastic material and has a top section 420 for extending across and spanning the top of the container 200 and engaging the container rim 212. A body section 422 extends from the periphery of the top section 420 and joins the top section 420 at a joint interface 434. The body section 422 of the present embodiment is a substantially cylindrical or slightly frusto-conical sidewall 430. In some embodiments, as best shown in FIG. 8, a plurality of tabs 436, 438 can extend from a bottom edge of the body section 422. At least one tab 438 can extend outwardly from the sidewall 430 at a substantially right angle, i.e. radially with respect to a longitudinal axis of the straw 412, for easy grasping by a user. One or more remaining tabs 436 extend in surface continuation or flush with the body section 422. The tabs 436, 438 can also include a ridge 437 on one surface thereof to aid the user in firmly gripping the tab 436, 438 without the user's fingers slipping off of the tab 436, 438.

As mentioned heretofore, the top section 420 has a substantially planar center area 421 which defines the orifice 424 therethrough. The orifice 424 can be circular for closely engaging the straw 412 to maintain a liquid seal, or alternatively, as shown, the orifice 424 can be an X-shaped cut through the center area 421 to accommodate a variety of diameters for straw 412 and remain sealed or substantially sealed when no straw is inserted therethrough. At least one and more preferably a plurality of circular expansion folds 418 are concentrically arranged about the center area 421 in increasing diametrical form, one expansion folds 418 joined to the next expansion folds 418 to the joint interface 434. Each expansion fold 418 is substantially V-shaped such that in cross-section, and as best illustrated in FIG. 9, the plurality of expansion folds 418 form an accordion-like structure extending between the center area 421 and the joint interface 434. While the individual expansion folds 418 are here illustrated as substantially V-shaped, those practiced in the art will readily recognize that other similar geometrical configurations can be utilized without departing from the inventive concepts disclosed herein.

In use, a container 210 which a user desires to cover can be placed on a flat surface. The user places the lid 410 proximate to the upper portion of the container 210 where the lid partially engages over the container rim 212. The user then grasps one or more of the tabs 436, 438 to circumferentially stretch the sidewall 430 to conform to the diameter of the container 210. Then, with the aid of tabs 436, 438, the user pulls the lid 410 down until the joint interface 434 securely abuts the container rim 212. The elastic nature of the sidewall 430 retains the lid 410 in position engaging the upper portion of the container 210. If not inserted already, the straw 412 can then be inserted through the orifice 424 in the center area 421. At such time as the user desires to remove the lid and straw combination 400, the user can grasp one or more of the tabs 436, 438 with one hand and the container 210 with the other and with the application of an upward force on the tabs 436, 438 removes the lid and straw combination 400 therefrom.

Figure 10:
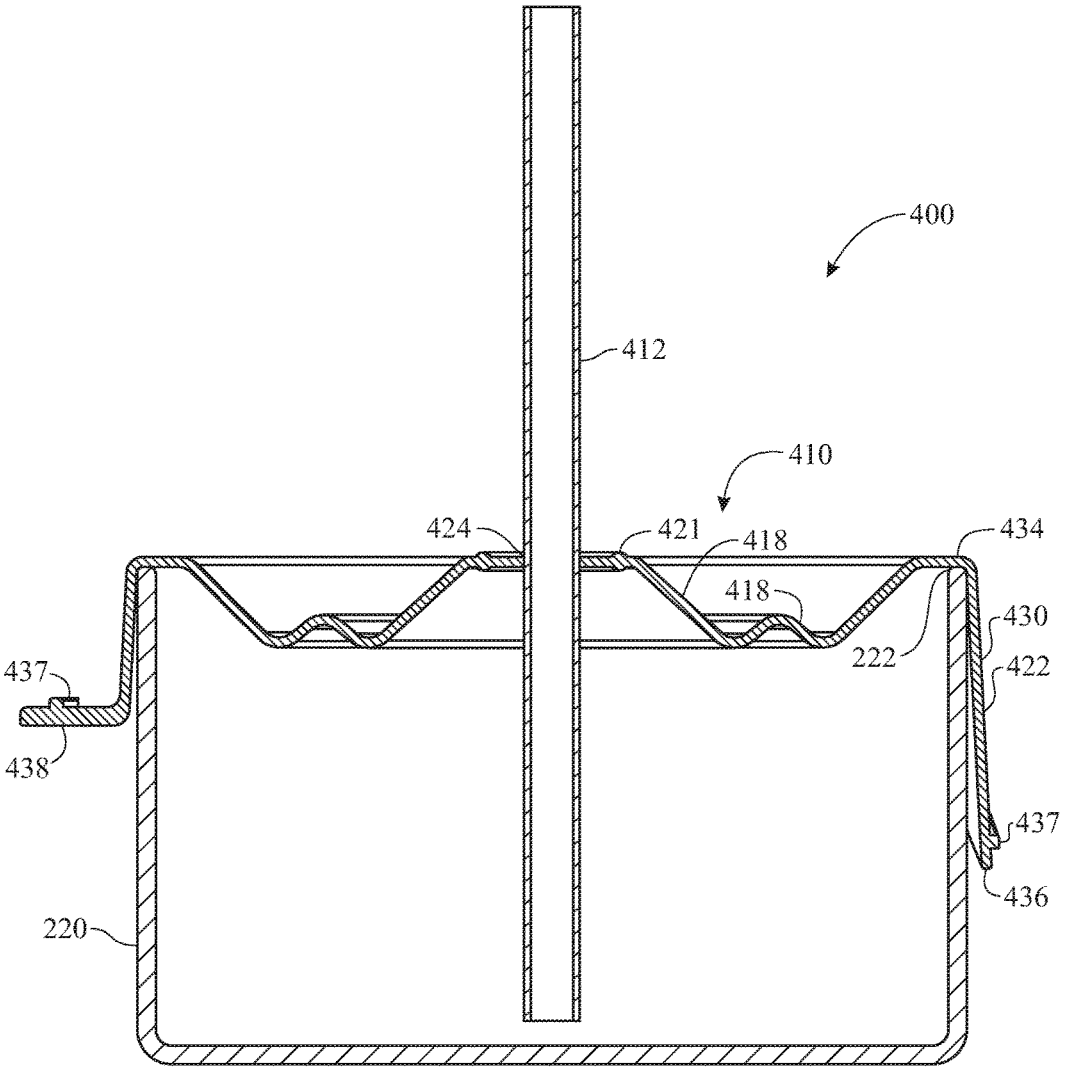
FIG. 10 presents a cross-sectional elevation view of the second embodiment lid and straw assembly on a container of a larger diameter.

As illustrated in FIG. 10, the same lid and straw combination 400 can be utilized on a container 220 having a diameter larger than the container 210 of FIGS. 7 through 9. The user places the lid 410 proximate to the upper portion of the container to 220 and again grasps the tabs 436, 438 to draw the sidewall 430 about the circumference of the upper portion of container 220. The elastic nature of the material from which the lid 410 is formed permits the sidewall 430 to be circumferentially stretched to engage the increased diameter of the container 220. Similarly, the top section 420 will also stretch circumferentially to accommodate the increased circumferential aspect of the container 220. The diametrical increase between container 210 and container 220 is accommodated by the expansion folds 418 in addition to the top section 420 and sidewall 430 being made from an elastic material. Specifically, as the top section 420 is stretched to engage the joint interface 434 with the upper rim 222 of container 220, the V-shaped expansion folds 418 at least partially unfold to accommodate the greater diameter of the container 220. Having the top section 420 made of an elastic material and also stretchable in an accordion-like manner increases deformability of the top section 420 and allows it to adopt a wider range of diameters than a flat top section 420 made of the same elastic material. To remove the lid and straw combination 400 the user again grasps one or more of the tabs 436, 438 and applies an upward force on the tabs 436 438 while countering with a downward force applied to the container 220 until the lid 410 is disengaged from the container 220. The lid 410 can then be washed and reused on another container.

The lid of the present disclosure is a universal covering having general applicability to a wider variety of glasses, cups, or other containers. Because of its elasticity, the universal lid fits on multiple-sized containers by stretching across the diameter of the container. The elastic deformation of the lid enables it to accommodate a variety of different-sized containers and to return to its original, relaxed state once it is removed from the container, allowing the lid to retain all of its elastic properties and to be reused in a consistent manner having a reliable expectation of performance. The universal lid offers cost savings by reducing the use of Styrofoam cups and plastic lids, especially during periods of high beverage consumption, e.g., work or home. The universal lid will save consumers money by allowing them to have a single lid that will fit all of the beverage containers they already own. Additionally, the universal lid is preferably washable and re-usable, and therefore eco-friendly.

The universal lid offers the benefit of providing a cover over any type of container, without the need for any specialized features that match or complement the container. For example, conventional beverage containers like travel mugs usually have some type of mechanism that couples the lid to the container. In one form, the mug can be provided with a threading surface on its exterior that mates with the threads of the screw-type lid. In another form, the lid comes with a peripheral recess that receives the rim of the container in a snap-on press fit. However, according to the invention, the universal lid requires no such mating features with the container. Instead, the universal lid is simply draped or placed over the container in a tight, elastic, conforming, sleeve-like fit that makes it impervious to fluid leakage. Even if the container is provided with external features (e.g., threading) to accommodate another lid, the universal lid of the invention will simply cover these features in a skirt-like fashion.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A container lid for covering containers of differing diameters, the container lid comprising:

a top section configured to extend over and cover a top opening of a container, the top section comprising two or more expansion folds arranged circumferentially about the center section of the top section, extending in a concentric relationship with one another, and forming a stretchable portion of the top section to increase or reduce a width of the top section such that the top section can conform to different top opening widths of different containers; and a sidewall extending downwardly from the top section around a full perimeter thereof; wherein the top section and sidewall are stretchable, elastic and fluid impervious; and wherein the two or more expansion folds are V-shaped in cross-section, and wherein an intersection of the V-shaped folds is axially lower than the center section and a top of the sidewall.

2. The container lid of claim 1, wherein the top section is circular and the sidewall is substantially cylindrical or frustoconical.

3. The container lid of claim 1, wherein the top section and the sidewall are integrally formed as a single-piece unit.

4. The container lid of claim 1, wherein the top section and the sidewall are attached to one another.

5. The container lid of claim 1, wherein the lid further includes a straw positioned at the top section and integrally formed with the top section.

6. The container lid of claim 1, wherein the top section comprises an orifice for removably receiving a straw therethrough.

7. The container lid of claim 1, further including one or more tabs extending from a bottom of the sidewall and away from the top section.

8. The container lid of claim 7, wherein at least one of the tabs extends radially outward front the bottom of the sidewall.

9. The container lid of claim 7, wherein at least one of the tabs extends from the bottom of the sidewall in surface continuation with the sidewall.

10. The container lid of claim 1, wherein the top section is formed of a fluid impervious elastic material.

11. The container lid of claim 1, wherein the sidewall is formed of a fluid impervious elastic material.

12. A container lid for covering containers of differing diameters, the container lid comprising:

a circular top section configured to extend over and cover a top opening of a container, and a substantially cylindrical or frustoconical sidewall extending downwardly from the top section around a full perimeter thereof, wherein the top section and sidewall are integrally formed into a joint, single-piece unit made of a stretchable, elastic and fluid impervious material; wherein the top section comprises a center section and two or more expansion folds extending circumferentially and concentrically about the center section, the two or more expansion folds forming a stretchable portion of the top section such that the top section can conform to different top opening diameters of different containers; and wherein the two or more expansion folds are V-shaped in cross-section, and wherein an intersection of the V-shaped folds is axially lower than the center section and a top of the sidewall.

13. The container lid of claim 12, further including one or more tabs extending from a bottom of the sidewall and away from the top section.

14. The container lid of claim 12, further comprising a straw extending through the center section of the top section, and integrally formed with the top section.

15. The container lid of claim 12, wherein the center section comprises an opening for the insertion therethrough of a straw.

16. A container lid for covering containers of differing diameters, the container lid comprising:

a circular top section configured to extend over and cover a top opening of a container, a substantially cylindrical or frustoconical sidewall extending downwardly from the top section around a full perimeter thereof, and at least one tab extending from the sidewall, wherein the top section, sidewall and the at least one tab are integrally formed into a joint, single-piece unit made of a stretchable, elastic and fluid impervious material; wherein the top section comprises a center section and two or more expansion folds extending circumferentially and concentrically from the center section, the two or more expansion folds forming a stretchable portion of the top section such that the top section can conform to different top opening diameters of different containers; and wherein the two or more expansion folds are V-shaped in cross-section, and wherein an intersection of the V-shaped folds is axially lower than the center section and a top of the sidewall.

17. The container lid of claim 16, further comprising a straw extending through the center section of the top section; and integrally formed with the top section.

18. The container lid of claim 16, wherein the center section comprises an opening for the insertion therethrough of a straw.

* * * * *